United States Patent [19]

Yasumoto

[11] Patent Number: 4,772,223

[45] Date of Patent: Sep. 20, 1988

[54] PHASE-ADJUSTABLE COAXIAL CABLE CONNECTOR

[75] Inventor: Hiromi Yasumoto, Iruma, Japan

[73] Assignee: Junkosha Co., Ltd., Tokyo, Japan

[21] Appl. No.: 104,417

[22] Filed: Oct. 2, 1987

[30] Foreign Application Priority Data

Oct. 3, 1986 [JP] Japan ..... 61-235838

[51] Int. Cl.[4] ..... H01R 17/18

[52] U.S. Cl. ..... 439/578; 333/160

[58] Field of Search ..... 439/578–585, 439/675, 98, 99, 166, 170, 171, 174, 175, 189, 217, 218, 322, 610, 662, 663; 324/158 F; 333/160, 245, 246, 260, 261, 223, 224

[56] References Cited

U.S. PATENT DOCUMENTS 2,644,140 6/1953 Pease ..... 333/160
3,480,888 11/1969 Elliot ..... 333/223
4,585,289 4/1986 Bocker ..... 439/581
4,648,683 3/1987 Botka ..... 439/583
4,687,279 8/1987 Holland et al. ..... 439/578

FOREIGN PATENT DOCUMENTS 1006665 10/1965 United Kingdom ..... 439/583

OTHER PUBLICATIONS

"Phase Adjustable SMA Connector Specifications", Aug. 1975, Saverio Bruno, Bunker Ramo Corp., pp. 11–16.

"Phase Adjustable SMA Connectors", Aug. 1975, Amphenol RF Product News.

*Primary Examiner*—David Pirlot

*Attorney, Agent, or Firm*—Mortenson & Uebler

[57] ABSTRACT

A phase-adjustable coaxial cable connector is provided. Phase adjustability is provided by means which increase or decrease the slack in a slackened portion of the center conductor of a coaxial cable which extends into the connector.

4 Claims, 1 Drawing Sheet

PHASE-ADJUSTABLE COAXIAL CABLE CONNECTOR

BACKGROUND OF THE INVENTION

The present invention relates to a coaxial cable connector which simplifies phase adjustment at terminal assembly of a coaxial cable.

Coaxial connectors which are intended for interconnection of the ends of coaxial cables are known in the art and described, for example, in Japanese Patent Publication (Kokai) No. 57-44,980.

In the case where such coaxial connectors are used in a coaxial cable assembly incorporated into a phase-array system of a radar which requires a predetermined phase, the coaxial connector is usually attached to one end of the coaxial cable, which preliminarily is provided with an excess length, which is then cut to a predetermined length on the basis of measurement of the phase by means of a pulse-reflection method. After matching the phase to a required value, another coaxial connector is attached to the opposite end of the cable. This is a very lengthy and inefficient procedure, which may lead to high expenses, especially in those cases where the cable is occasionally cut to a length which is shorter than actually required.

The present invention substantially eliminates the disadvantages inherent in the prior art devices and provides a coaxial cable connector which removes the possibility of wasting the cable and makes it possible to adjust the phase of the cable after connection is made.

SUMMARY OF THE INVENTION

A phase-adjustable coaxial cable connector is provided having a cylindrical connector body of conductive metal supporting a metal coupling at one end of the connector body, the coupling being rotationally but not axially moveable with respect to the connector body, the connector body being threadingly engaged at its other end with an adjustable coaxial cable support member, the support member supporting a coaxial cable therein, which cable has a center conductor and a conducting shield separated by a dielectric material, the center conductor extending beyond the coaxial cable and into the connector body and having a slackened portion or bend within the connector body, the center conductor extending into the connector body and being affixed to a central connecting and conducting pin element therein extending into the coupling and being supported within the coupling by a dielectric material which separates the coupling and the pin element, the pin element being rotationally moveable within the dielectric, whereby rotational movement of the adjustable coaxial cable support member results in axial displacement of the support member with respect to the connector body thereby causing more or less slack in the slackened portion and provides means for adjusting the electrical path length of the connector to permit phase adjustability. In an alternate embodiment, a connector is provided comprising a cylindrical connector body of conductive metal supporting a metal coupling at one end of the connector body, the coupling being rotationally but not axially moveable with respect to the connector body, a coaxial cable support member supporting a coaxial cable being engaged at the other end of the connector body, the support and connector body being rotatably moveable with respect to each other, the coaxial cable having a center conductor and shield separated by a dielectric material, the center conductor extending into the connector body and being affixed to a contact element therein, the contact element being threadingly engaged with a central connecting and conducting pin element extending into the coupling and being supported within the coupling by a dielectric material which separates the coupling and the central connecting element, whereby, rotational movement of the coaxial cable results in axial displacement of the contact member with respect to the central connecting and conducting pin element, thereby providing means for adjusting the electrical path length of the connector to permit phase adjustability. The connectors may have at least one impedance-adjusting screw threaded into the cylindrical connector body.

DETAILED DESCRIPTION OF THE INVENTION AND PREFERRED EMBODIMENTS WITH REFERENCE TO THE DRAWINGS

A phase-adjustable coaxial cable connector is provided. Phase adjustability is provided by means which increase or decrease the slack in a slackened portion of the center conductor of a coaxial cable which extends into the connector.

The present invention provides a phase-adjustable coaxial connector comprising a conductive connector cylinder having a coupling on one end, a central connecting element which is supported by one end of the connector cylinder through an insulation, and an adjustable element which is supported by the other end of the connector cylinder so that it can be moved axially with respect to the connector cylinder while maintaining electrical contact therewith, the adjustment element supporting the end of the coaxial cable and being in electrical contact with the external conductive element of the cable.

The connector of the above-mentioned type is advantageous in that by attaching the central conductor of the coaxial cable to the central connecting element of the connector and by moving the contact element through the adjustment element, it is possible to adjust the phase of the coaxial cable and at the same time to protect the central conductor from concentration of stress. The connector cylinder may have impedance-adjusting screws moveable with respect to the central conductor. These screws can be used for compensation of deviations in the value of the characteristic impedance.

In the device of the invention, because the adjustment element which supports one end of the coaxial cable is moveable axially with respect to the connector cylinder, it becomes possible to provide microscopic adjustment of the length (i.e., the electric length, and hence the phase-path length) of the cable assembly.

Variation in characteristic impedance, which may be caused by displacement of the adjustment element in the connector, is compensated by means of impedance adjusting screws which are installed in the connector cylinder.

The central connector supports a contact element which is moveable with respect to the central connector, is electrically connected to the latter, and is fixed to the central conductor of the coaxial cable. Because this contact element is electrically connected to the central connector, and, at the same time, is moveable in response to the displacement of the adjustment element, it will protect the central conductor from twisting and concentration of stress.

A detailed description of the invention and preferred embodiments is best provided with reference to the drawings.

Figure 1:
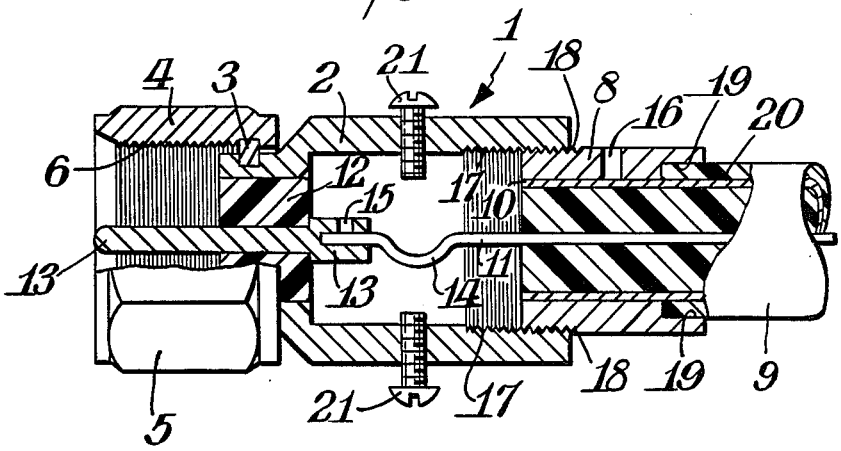
FIG. 1 is a side elevational view, partly in cross section, of a phase-adjustable coaxial connector in accordance with one embodiment of the present invention.

FIG. 1 shows a longitudinal, partially-sectional view of a phase-adjustable coaxial connector 1, made in accordance with one embodiment of the present invention.

Phase-adjustable coaxial connector 1 has a connector cylinder body 2, which is made from a conductive material, for example, from metal. Cylinder 2 supports at its one end a coupling 4 which can rotate around the cylinder, but is restrained against axial movements by a cotter ring 3. The external part of coupling 4 is preferably formed as a hexagonal nut which can be rotated by a tool. By means of a female thread 6, which is formed inside coupling 4, the latter can be attached to an appropriate male connecting counterpart on an instrument, etc. Coupling 4 is made of a conductive material such as metal, so that it is electrically connected to an external conductor 10 of a coaxial cable 9 through connector cylinder 2 and an adjustment element 8.

Central conductor 11 of coaxial cable 9 is electrically connected with a central connecting element 13 which is supported in connector cylinder 2 by a dielectric body 12. In establishing electrical contact between central conductor 11 and connecting element 13, central conductor 11 is preliminarily slackened or bent at a portion 14 and is then fixed in connecting element 13 by soldering. For this purpose, connecting element 13 has a solder feeding opening 15. External conductor 10 of coaxial cable 9 is connected to adjustment element 8 electrically and mechanically by soldering. For this purpose, adjustment element 8 has in its wall a through opening 16 for the supply of the solder. Adjustment element 8 has on its periphery a male thread 18 which is screwed into a female thread 17, made inside connector cylinder 2 on the side opposite to coupling 4. The above-mentioned threaded connection makes it possible to adjust the length (i.e., the electrical length) of the entire cable assembly. In the illustrated embodiment, the front end of coaxial cable 9 with the outer sheath 20 is supported by the connector through a recess 19 cut in the adjustment element on the side opposite to thread 18. To this end, the front end of the coaxial cable coated with sheath 20 is inserted into recess 19. It is understood, however, that other types of connections can be used for this purpose. For example, the end of the cable can be threaded or pressed into a cable-supporting ring (not shown).

With phase-adjustable coaxial cable connector 1 of the above-described type, after assembling the connector with coaxial cable 9, the microscopic adjustment of the phase, variation of the phase of the cable, i.e., of its electric length, is performed by rotating adjustment body 8 with respect to cylinder body 2. The adjustment makes it possible to match the arbitrary characteristic impedance, which is determined by the amount of extension of slackened portion 14 of central conductor 11, with the characteristic impedance of coaxial cable 9. Variations can be compensated by impedance-adjusting screws 21 which are threaded into connector cylinder 2 towards the central conductor.

Figure 2:
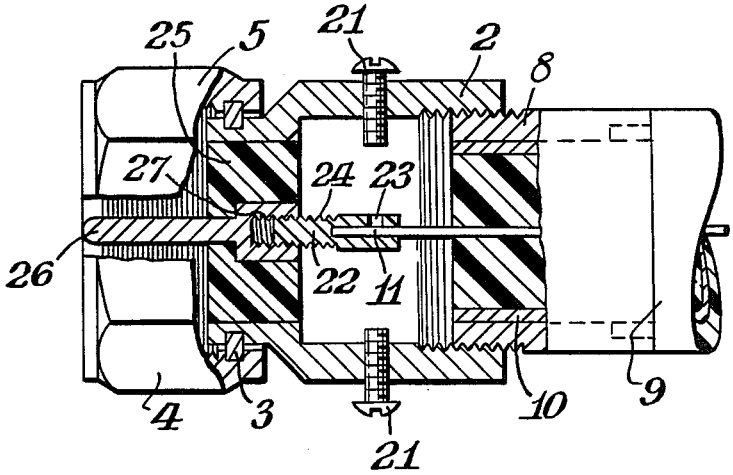
FIG. 2 is a similar representation of a coaxial connector in accordance with another embodiment of the invention.

FIG. 2 illustrates another embodiment of the present invention. A distinctive feature of this embodiment is a central, axially adjustable connecting element. Central conductor 11 is attached mechanically and electrically to a contact element 22 by soldering. The soldering is performed by supplying solder through opening 23. Contact element 23 is provided on its outer periphery with a male thread 24, and is supported in the connector cylinder (which is not shown in FIG. 2) through a dielectric body 25, which supports a central connector 26, having a female thread 27 engaged with the above-mentioned thread 24. When an adjustment element (not shown in the drawings) is rotated and therefore moved axially, i.e., when coaxial cable 9 is rotated, this movement causes rotation of contact element 22 as well. As a result, the electric length of the coaxial cable, i.e., of central conductor 11 is changed. In this embodiment, contact element 22 and central connecting element 26 are interconnected through a thread, but instead of this, they may have a sliding electric contact.

It is understood that the scope of the present invention is not limited only to the above-described embodiments. For example, apart from the coupling, other elements and other materials can be used for connection of the external conductor. Therefore, modifications are possible without departure from the spirit of the invention.

Thus, it has been shown that the present invention provides a phase-adjustable coaxial connector comprising a conductive connector cylinder having a coupling on one end, a central connecting element which is supported by one end of the connector cylinder through an insulation, and an adjustment element which is supported by the other end of the connector cylinder, so that it can be moved axially with respect to the connector cylinder, while maintaining electrical contact therewith, the adjustment element supporting the end of the coaxial cable and being in electrical contact with the external conductive element of the cable.

The use of the coaxial connector of the above-described type suggests the following effects:

(1) Assembly time is shortened; (2) Assembly does not require skilled labor; (3) The cable is not damaged; (4) Because the connector allows for multiple adjustments, mistakes can be corrected, and the connector possesses high utility; and, (5) When the phase is adjusted by attaching the connectors to both ends of the cable, the measurements can be checked by a pulse-passage method. This improves the accuracy of adjustment.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A phase-adjustable coaxial cable connector comprising a cylindrical connector body of conductive metal supporting a metal coupling at one end of said connector body, the coupling being rotationally but not axially moveable with respect to said connector body, said connector body being threadingly engaged at its other end with an adjustable coaxial cable support member, said support member supporting a coaxial cable therein, which cable has a center conductor and a conducting shield separated by a dielectric material, said center conductor extending beyond said coaxial cable and into said connector body and having a slackened portion or bend within said connector body, said center conductor being affixed to a central connecting and conducting pin element therein extending into said coupling and being supported within said coupling by a dielectric material which separates said coupling and said central connecting element, said element being rotationally moveable within said dielectric, whereby, rotational movement of said adjustable coaxial cable support member results in axial displacement of said support member with respect to said connector body thereby causing more or less slack in said slackened portion and providing means for adjusting the electrical path length of said connector to permit phase adjustability.

2. The phase-adjustable coaxial cable connector of claim 1 having at least one impedance-adjusting screw threaded into said cylindrical connector body.

3. A phase-adjustable coaxial cable connector comprising a cylindrical connector body of conductive metal supporting a metal coupling at one end of said connector body, the coupling being rotationally but not axially moveable with respect to said connector body, a coaxial cable support member supporting a coaxial cable being engaged at the other end of said connector body, said support member and connector body being rotatably moveable with respect to each other, said coaxial cable having a center conductor and shield separated by a dielectric material, said center conductor extending into said connector body and being affixed to a contact element therein, said contact element being threadingly engaged with a central connecting and conducting pin element extending into said coupling and being supported within said coupling by a dielectric material which separates said coupling and said central connecting element, whereby, rotational movement of said coaxial cable results in axial displacement of said contact element with respect to said central connecting and conducting pin element thereby providing means for adjusting the electrical path length of said connector to permit phase adjustability.

4. The phase-adjustable coaxial cable connector of claim 3 having at least one impedance-adjusting screw threaded into said cylindrical connector body.

* * * * *